US006470614B1

(12) United States Patent
Johnson

(10) Patent No.: US 6,470,614 B1
(45) Date of Patent: Oct. 29, 2002

(54) CARTRIDGE FOLLOWER FOR SHOTGUN MAGAZINE

(76) Inventor: David A. Johnson, P.O. Box 12517, Salem, OR (US) 97309

( * ) Notice: Subject to any disclaimer, the term of this patent is extended or adjusted under 35 U.S.C. 154(b) by 0 days.

(21) Appl. No.: 09/952,922

(22) Filed: Sep. 14, 2001

(51) Int. Cl.[7] ..... F41A 09/18
(52) U.S. Cl. ..... 42/17; 42/21; 42/49.01
(58) Field of Search ..... 42/17, 21, 49.01, 42/33.01, 34, 1.01, 1.02; F41A 19/19, 3/00

(56) References Cited

U.S. PATENT DOCUMENTS

| | | | | | |
|---|---|---|---|---|---|
| 343,471 | A | | 6/1886 | Maynard | |
| 382,455 | A | * | 5/1888 | Butler | 42/49.01 |
| 1,252,094 | A | | 1/1918 | Lempdes | |
| 1,518,975 | A | * | 12/1924 | Ehrhardt | 42/17 |
| 1,740,187 | A | * | 12/1929 | Loomis | 42/17 |
| 1,874,952 | A | | 8/1932 | Frank | |
| 2,026,252 | A | * | 2/1935 | Russell et al. | 42/49.01 |
| 3,510,951 | A | * | 5/1970 | Dow | 33/506 |
| 3,913,251 | A | | 10/1975 | Browning | 42/49 |
| 4,109,401 | A | * | 8/1978 | Musgrave | 42/1.01 |
| 4,142,313 | A | | 3/1979 | Musgrave | 42/1 |
| 4,216,601 | A | | 8/1980 | Musgrave | 42/1 |
| 4,486,966 | A | | 12/1984 | Seehase | 42/1 |
| 4,587,756 | A | | 5/1986 | Jakubaschk et al. | 42/1 |
| 4,912,868 | A | | 4/1990 | Thompson | 42/77 |
| D311,935 | S | * | 11/1990 | Andersen | D21/108 |
| D360,239 | S | * | 7/1995 | Knudsen | D21/108 |
| 5,638,626 | A | | 6/1997 | Westrom | 42/50 |
| D387,398 | S | * | 12/1997 | Ohrwald | D21/108 |
| D410,974 | S | * | 6/1999 | Toft | D21/488 |
| 6,094,850 | A | | 8/2000 | Villani | 42/1.02 |

* cited by examiner

*Primary Examiner*—Charles T. Jordan
*Assistant Examiner*—John W. Zerr
(74) *Attorney, Agent, or Firm*—Chernoff, Vilhauer, McClung & Stenzel, LLP

(57) ABSTRACT

A cartridge follower for pushing against cartridges in a tubular magazine of a shotgun. A front face of the follower has at least one forwardly protruding member offset from the center of the front face to be tactilely distinguished from a cartridge in the magazine, but which cannot contact a central primer of a backwards cartridge. A method for determining whether a shotgun is empty includes providing such a follower in the magazine, inserting a finger into the outfeed end of a magazine, and attempting to feel the protruding member.

17 Claims, 3 Drawing Sheets

CARTRIDGE FOLLOWER FOR SHOTGUN MAGAZINE

BACKGROUND OF THE INVENTION

The present invention relates to a cartridge follower for a tubular magazine for a firearm, and in particular to such a follower that can be identified easily by touch.

Repeating shotguns use tubular linear magazines in which cartridges, also called shells, are stacked one behind another in the magazine. A spring loaded follower at the front end of the magazine pushes back against the front of the first cartridge loaded into the magazine, which will be the last cartridge actually loaded into the chamber of the shotgun. The follower urges the cartridges rearwardly into position to be fed one by one into the chamber. In the past followers have usually had a flat face that contacts the front of a cartridge.

Without operating the loading mechanism, the only way to tell reliably when the magazine of a typical repeating shotgun is empty is to examine the firearm visually. However, this is often impractical. Police and military shotguns are often used under adverse conditions such as at night or when visibility is poor, when it would be dangerous or impossible to visually examine the shotgun.

Many shotguns employ a lifter which elevates each cartridge into alignment for being pushed into the chamber. Between rounds or while the shotgun is being loaded, a finger can be inserted past the lifter to the rear of the magazine, and the next cartridge in the magazine to be loaded, or the follower, can be touched. If the follower and the primer of a cartridge could be distinguished by touch, a user could determine whether a shotgun magazine was empty or not. Because police and military shotguns are often used at night or when visibility is low, a follower that can be distinguished from a shell by touch would be particularly useful to indicate whether the firearm magazine is loaded.

Therefore, several attempts have been made in the past to provide a follower which can be distinguished definitely from a shell by touch. Such a follower should be distinguishable by touch even when the user is wearing gloves, because police and military firearm users frequently wear fire-resistant gloves.

One such previously-known follower 10 has a small raised bump 12 in the center of the face of the follower as shown in FIG. 1. The bump 12 allows a user to distinguish the follower 10 from a cartridge by touch to determine whether the magazine is empty. However, such a centrally located bump 12 has a significant disadvantage. If a shotgun shell were placed backward in the magazine by mistake the bump 12 of the follower would press on the percussion-operated primer located in the center of the base of the shotgun shell, resulting in the risk that the follower could fire the shell in the magazine, causing significant damage and risk of serious injury.

Another prior art follower 14, shown in FIG. 2, has a protruding small end 16 of a central rod surrounded by a deep annular cavity 18. However, it has been found that when a shotgun is employed in field conditions the annular cavity 18 can fill with foreign material and make the end 16 difficult to distinguish from a cartridge by touch. This follower 14 also has the disadvantage of being capable of firing a misloaded shell in the magazine because of the protrusion of the end 16 of its centrally located rod.

Another prior art follower 20, shown in FIG. 3, includes a flat circular protrusion centrally located on the face of the follower 22. The circular protrusion has a diameter of 9.53 mm, and protrudes from the face of the follower 0.89 mm. While such a protrusion is unlikely to set off the primer of a cartridge loaded backwards into the magazine, it is also too broad to be easily distinguishable from a cartridge by touch.

Therefore, what is still needed for a shotgun magazine is a cartridge follower that can be distinguished easily from a shell by touch, but which cannot easily fill with foreign material or accidentally discharge a shell inadvertently loaded backwards into the magazine.

SUMMARY OF THE INVENTION

The present invention overcomes the drawbacks of the prior art by providing for use in a shotgun magazine a follower that can be distinguished from a shell by touch but which cannot inadvertently discharge a shell loaded backwards in the magazine. The invention provides a follower for pushing against cartridges with a front face that has at least one protruding member offset from the center of the face. The follower thus is easily identifiable by touch, but cannot fire a shell inadvertently loaded backwards into the magazine.

In one preferred embodiment of the invention the follower has at least two protruding members each located far enough from the center of the front face to avoid contact with the primer of a shell loaded backward in the magazine.

The present invention also provides a method for determining whether a shotgun magazine is empty by providing, in the magazine, a cartridge follower with a front face for pushing against cartridges which has at least one protruding member offset from the center of the front face, and determining whether the magazine is empty by inserting a finger into the outfeed end of the magazine and attempting to feel the protruding member of the follower.

The invention thus allows the user of a shotgun to distinguish by feel between the follower of the magazine cartridge and a shell remaining in the magazine, thereby determining whether or not he or she needs to reload and whether the firearm is safe to be transported. This determination can be made at night or under conditions of low visibility such as are often encountered by police and military shotgun users. The determination can be made regardless of whether the breech of the shotgun is open or closed, making the invention particularly valuable for police or military users who may be endangered unnecessarily if they run out of ammunition or mishandle a loaded firearm believed to be empty.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figures 1, 2, 3, 4, 5:
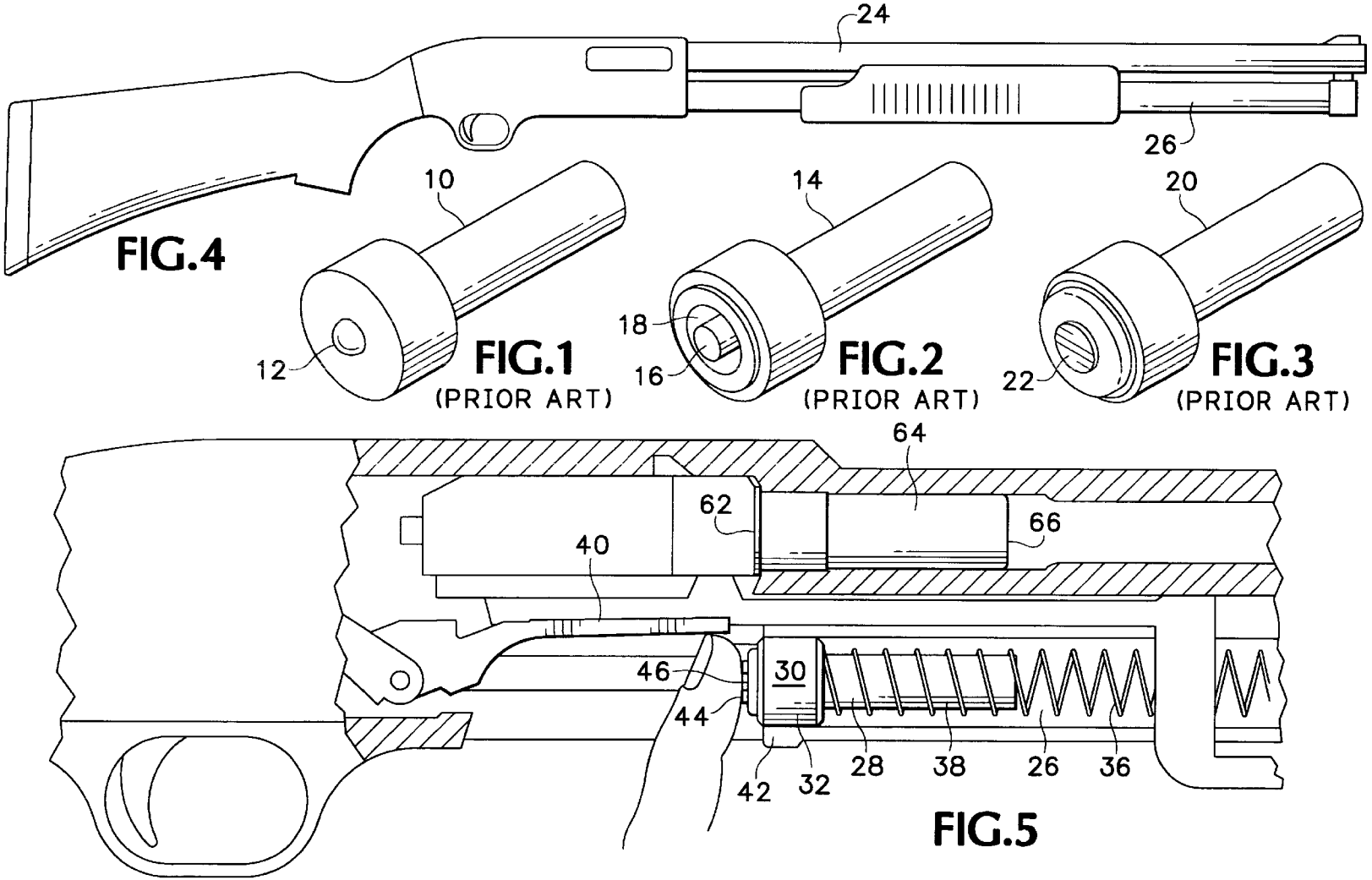
FIG.1 (PRIOR ART)
FIG.2 (PRIOR ART)
FIG.3 (PRIOR ART)
FIG. 1 is an isometric view of a prior art follower for the magazine of a shotgun such as that shown in FIG. 4.
FIG. 2 is an isometric view of another prior art follower.
FIG. 3 is an isometric view of a further prior art follower.
FIG. 4 is a side view of a police or military style repeating shotgun with a long tubular magazine.
FIG. 5 is a partially cutaway view of a portion of the shotgun shown in FIG. 4 showing a cartridge follower in the magazine which is a preferred embodiment of the present invention.

Referring now to the drawings which form a part of the disclosure and wherein like numerals refer to like elements, FIG. 4 shows a military or police type shotgun 24 with a long tubular linear magazine 26 capable of holding up to ten shells. The present invention is particularly useful in such a shotgun because of the greater capacity of the magazine 26 and the adverse conditions under which such shotguns are employed.

Figure 6:
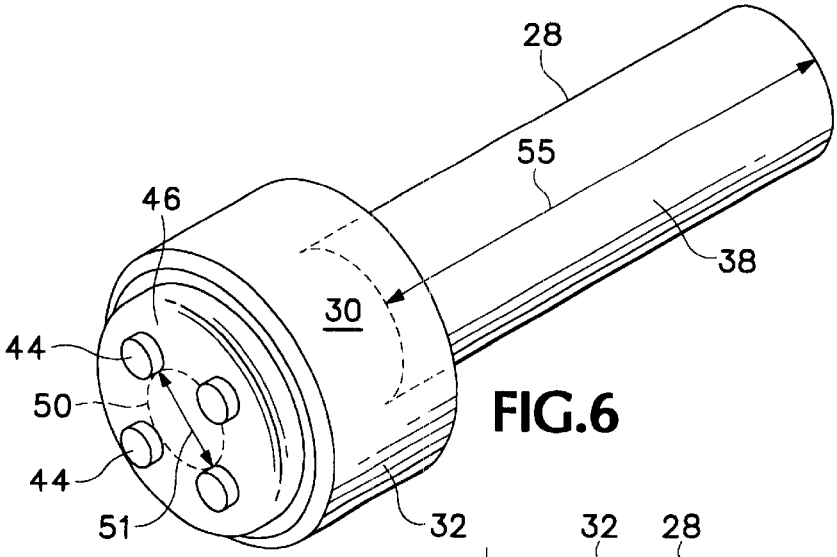
FIG. 6 is an isometric view of the cartridge follower shown in FIG. 5.
Figure 7:
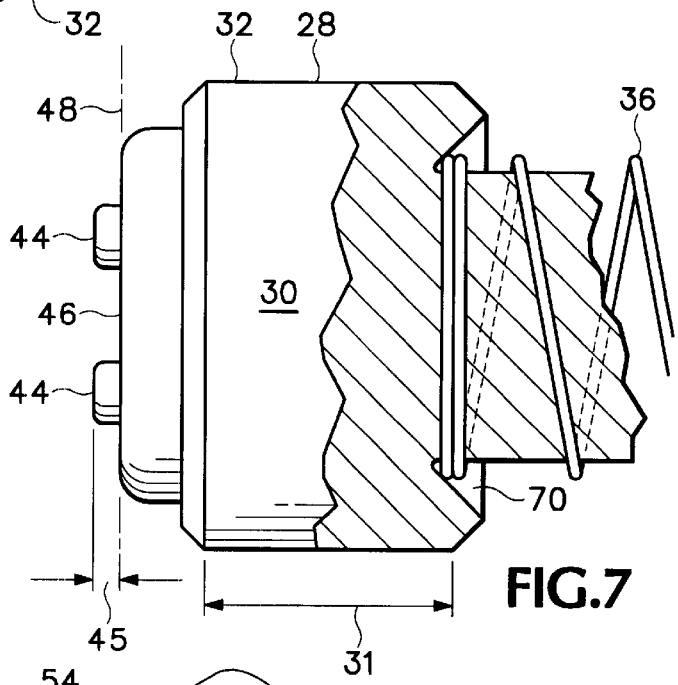
FIG. 7 is a partially cutaway view of the follower shown in FIGS. 5 and 6.

Referring to FIG. 5, a follower 28 which is one preferred embodiment of the invention is shown in the tubular magazine 26 of the shotgun. The follower 28, also shown separately in FIGS. 6 and 7, is located within the magazine 26, with the peripheral surfaces 30 of a generally cylindrical body portion 32 in easy sliding contact with the interior surfaces 34 of the magazine 26 keeping the follower 28 oriented within the magazine. The length 31 of the generally cylindrical body portion 32, for example, may be 12 mm so as to provide a fairly large peripheral surface 30 to stabilize the follower 28 in the magazine 26. An end of a compression spring 36 fits around a smaller diameter rear end section 38 of the follower 28 and is used to urge the follower 28 rearward in the magazine 26 to exert pressure on a shell within the magazine.

The follower is accessible to touch between the loading of shells as may be seen in FIG. 5, since the lifter 40, which is normally in a down position and blocks access to the magazine and chamber, can be pushed up with a finger, permitting access to the magazine and the follower. To determine whether the magazine 26 is empty, a person using the shotgun 24 inserts a finger or thumb under the lifter 40 and into the outfeed end 42 of the magazine 26 to try to contact and feel the protrusions 44 located on the face 46 of the follower.

The face 46 defines a base plane 48 and has one or more protrusions 44 which extend from the base plane 48 toward any cartridge present in the magazine. The face 46 surrounding the protrusions 44 is flat and smooth, resisting the accumulation of foreign debris. The height 45 of the protrusions 44 relative to the base plane 48 may be in the range of 0.5 mm to 1.5 mm and preferably approximately 1 mm, since a height 45 greater than 1.5 mm may damage a cartridge, and a height 45 less than 0.5 mm may be too small for the protrusions to be felt easily. A center portion 50 of the face 46, indicated by a broken line, is preferably free of protrusions except to the extent that any protrusion is of a height no greater than that of other protrusions located outside the center portion. If any centrally located protrusion has a height no greater than that of at least one protrusion located outside the center portion, the off-center protrusion will prevent the centrally located protrusion from firing a shell inadvertently loaded backward in the magazine. The diameter 51 of the center portion 50 should be at least 5 mm and may preferably be between 7 mm and 10 mm because the primer exclusive of its retaining shell of a typical shotgun shell is approximately 5 mm in diameter. A center portion 50 free of protrusions that is 7 to 10 mm in its diameter 51 insures that no protrusion can contact the primer and discharge the shell.

The smaller diameter rear portion 38 of the follower 28 fits inside the spring 36 freely enough for the spring to extend easily, and preferably has a length 55 great enough to encounter the far end of the magazine and prevent the spring from being damaged by an attempt to load too many shells. The protrusions 44 are spaced apart from each other around the center portion 50. In the follower 28 shown in FIGS. 5, 6 and 7 there are four generally cylindrical similar protrusions 44.

In the follower 28 the surface of the smaller diameter rear section 38 of the follower, together with the rear end of the large diameter body section 32, defines a circumferential groove 70. The groove 70 allows more room for the compressed spring 36, in order to better accommodate a full magazine while not decreasing the peripheral surface area 30 of the large diameter body section 32 of the follower 28 in contact with the interior surface of the magazine 34.

Figure 8:
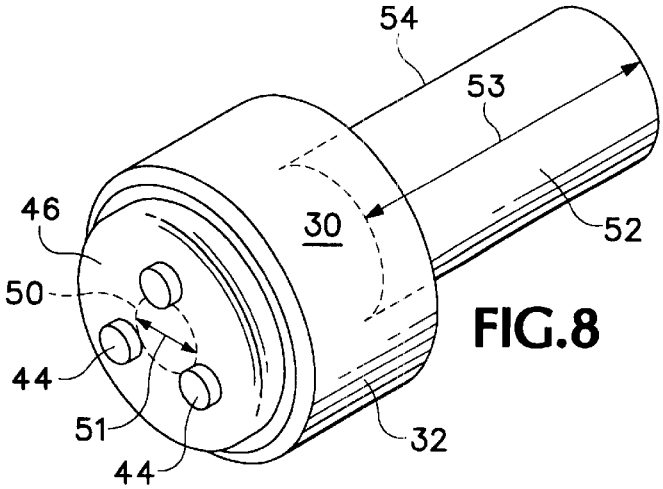
FIG. 8 is an isometric view of a follower that is an alternative preferred embodiment of the invention.

Alternatively, in the follower 54 shown in FIG. 8, there are only three protrusions 44, and the length 53 of the smaller diameter rear portion 52 is shorter than the length 55 of the smaller diameter rear portion of the follower 28 shown in FIG. 6 so that the follower can be used in a magazine of smaller capacity.

Figures 9, 10, 11:
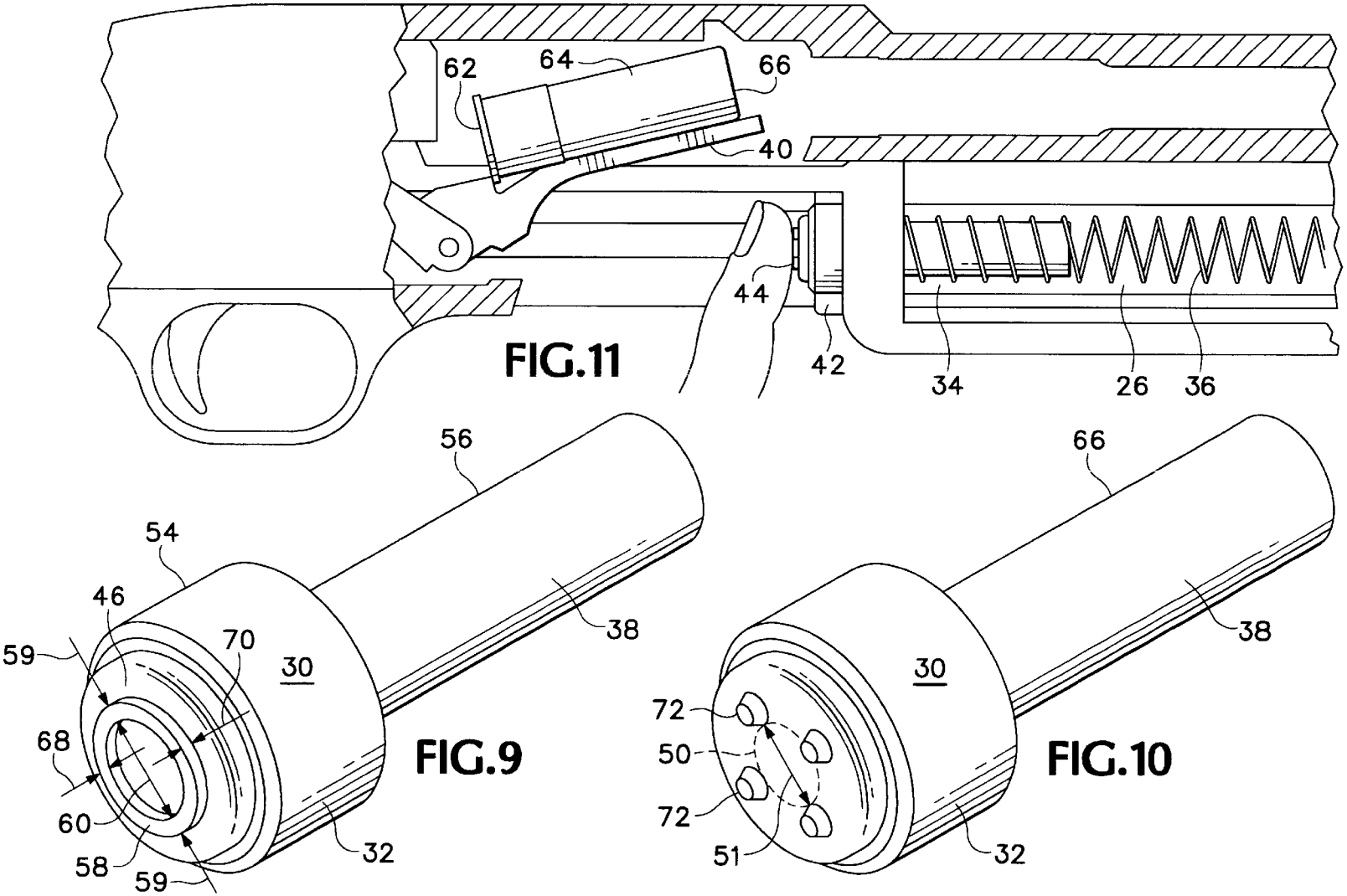
FIG. 9 is an isometric view of yet a further alternative preferred embodiment of the invention.
FIG. 10 is an isometric view of a follower that is an alternative preferred embodiment of the invention.
FIG. 11 is a partially cutaway view of a portion of the shotgun shown in FIG. 4, equipped with a follower according to the invention, showing a shell being loaded.

FIG. 9 shows a follower 56 which is an alternative embodiment of the invention and has one annular protrusion 58, or ring, located on the face of the follower 46. The annular protrusion 58 has an interior diameter 60 of at least 5 mm, larger than the primer of a shotgun shell, and surrounds but does not occupy any of the central portion 50 of the front face 46 of the body 32. The interior diameter 60 may, for example, be in the range of 8 mm to 10 mm and in the follower 56 is about 9 mm, which is large enough to be felt definitely as being different from the essentially flat base 62 of a shell 64, shown in FIGS. 5 and 11, yet the outside diameter 59, for example, 10 mm to 18 mm, of the annular protrusion 58 is noticeably smaller than that of the crimped edge of the front of a shell 66 so as not to confuse the follower with a cartridge loaded backwards. The radial width 68 of the annular protrusion 58 is preferably in the range of 1 mm to 4 mm so that the ring 58 can easily be felt but is sturdy, and in one preferred embodiment of the invention the radial width is about 2 mm. The annular protrusion 58 has a height 70 similar to the height 45 of each protrusion 44.

Protruding members 44 may be roughly cylindrical as shown in FIGS. 6, 7 and 8 or may have another shape, such as shown in FIG. 10, in which the follower 66 has frustoconical protrusions 72. Protrusions may also be bullet-shaped or hemispherical (not shown).

As shown in FIG. 11, during the loading process, the lifter 40 elevates a shell 64 into alignment with the breech. During this time the follower 28, or the rearmost one of any shells remaining in the magazine, is exposed and can be readily felt and identified by inserting a finger or thumb into the outfeed end 42 of the magazine 26.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A cartridge follower for a tubular magazine for a firearm, comprising:

(a) a body having a lateral peripheral surface, a rear end adapted to be engaged by a follower spring, and a generally circular front face, said front face having a center portion and defining a base plane;

(b) at least one forwardly protruding member located on said front face and having a height relative to said base plane sufficient for said protruding member to be readily discernable by touch; and (c) said center portion of said front face being free of protruding members.

2. The follower of claim 1 wherein said center portion of said front face is an area larger than the primer of a typical shotgun shell.

3. The follower of claim 1 wherein said center portion of said front face is an area at least 5 mm in diameter.

4. The follower of claim 1 wherein an area of said front face surrounding said protruding member is flat.

5. The follower of claim 1 wherein an area of said front face surrounding said protruding member is smooth.

6. The follower of claim 1 wherein said at least one protruding member has a height relative to said base plane between 0.5 mm and 1.5 mm.

7. The follower of claim 1 wherein said at least one protruding member comprises one annular protrusion and said annular protrusion has a height relative to said base plane sufficient to be readily discernable by touch.

8. The follower of claim 7 wherein said annular protrusion has a height relative to said base plane between 0.5 mm and 1.5 mm.

9. The follower of claim 7 wherein said annular protrusion surrounds a portion of said front face including said center portion.

10. The follower of claim 7 wherein the annular protrusion has an interior diameter larger than that of the primer of a typical shotgun shell.

11. The follower of claim 7 wherein the annular protrusion has an interior diameter of at least 5 mm.

12. The follower of claim 7 wherein said annular protrusion has a radial width in the range of about 1 to 4 mm.

13. The follower of claim 1 wherein said at least one protruding member is cylindrical.

14. The follower of claim 1 wherein said at least one protruding member is frusto-conical.

15. A cartridge follower for a tubular magazine for a firearm, comprising:

(a) a body having a lateral peripheral surface, a rear end adapted to be engaged by a follower spring, and a front face, said front face having a center portion and defining a base plane;

(b) a plurality of forwardly protruding members located on said front face at least one of said protruding members having a height relative to said base plane sufficient for said at least one of said protruding members to be readily discernable by touch; and (c) said height of any protruding member located in said center portion being no greater than said height of any other of said plurality of protruding members.

16. A method for determining whether a tubular magazine for a firearm is empty, comprising:

(a) providing, within a tubular magazine for a firearm, a cartridge follower including:

(i) a body having a lateral peripheral surface, a rear end adapted to be engaged by a follower spring, and a front face, said front face having a center portion and defining a base plane;

(ii) at least one forwardly protruding member located on said front face and having a height relative to said base plane sufficient for said protruding member to be readily discernable by touch; and (iii) said center portion of said front face being free of protruding members; and (b) inserting a finger into an outfeed end of said magazine and attempting to feel said at least one protruding member of said follower and determining by feeling said protruding member that said magazine is empty and by failing to feel said protruding member determining that said magazine should be considered not to be empty.

17. In combination with a tubular magazine for a firearm, a follower comprising:

(a) a body having a lateral peripheral surface, a rear end adapted to be engaged by a follower spring, and a generally circular front face, said front face having a center portion and defining a base plane;

(b) at least one forwardly protruding member located on said front face and having a height relative to said base plane sufficient for said protruding member to be readily discernable by touch; and (c) said center portion of said front face being free of protruding members.

* * * * *